US011794062B2

(12) United States Patent
Baucamp

(10) Patent No.: US 11,794,062 B2
(45) Date of Patent: Oct. 24, 2023

(54) TRAINING APPARATUS

(71) Applicant: Dave Baucamp, Meilen (CH)

(72) Inventor: Dave Baucamp, Meilen (CH)

( * ) Notice: Subject to any disclaimer, the term of this patent is extended or adjusted under 35 U.S.C. 154(b) by 0 days.

(21) Appl. No.: 17/280,068

(22) PCT Filed: Sep. 28, 2018

(86) PCT No.: PCT/EP2018/076521

§ 371 (c)(1),
(2) Date: Mar. 25, 2021

(87) PCT Pub. No.: WO2020/064131

PCT Pub. Date: Apr. 2, 2020

(65) Prior Publication Data

US 2021/0402244 A1 Dec. 30, 2021

(51) Int. Cl.
*A63B 21/078* (2006.01)

(52) U.S. Cl.
CPC ..... *A63B 21/078* (2013.01); *A63B 2225/09* (2013.01)

(58) Field of Classification Search
CPC ..... A63B 21/4047; A63B 21/00047; A63B 21/0724; A63B 21/078; A63B 21/0783; A63B 21/4029; A63B 2225/09
See application file for complete search history.

(56) References Cited

U.S. PATENT DOCUMENTS 5,433,687 A * 7/1995 Hinzman ..... A63B 21/078 248/580
6,475,127 B1 * 11/2002 Koenig ..... A63B 21/078 482/142
6,689,027 B1 * 2/2004 Gardikis, Jr. ..... A63B 21/078 482/142
6,746,379 B1 * 6/2004 Brawner ..... A63B 21/0783 482/112
7,654,944 B1 * 2/2010 Liu ..... A63B 21/078 482/142
7,674,215 B1 * 3/2010 Swanson ..... A63B 23/00 482/142
9,707,438 B2 * 7/2017 Vorozilchak ..... A63B 21/0724
10,071,276 B2 * 9/2018 Vorozilchak ..... A63B 21/0724
10,300,328 B2 * 5/2019 Lagree ..... A63B 22/0023
10,398,929 B2 * 9/2019 Hsieh ..... A63B 21/4029
10,675,499 B2 * 6/2020 Vorozilchak ..... A63B 21/4029
(Continued)

FOREIGN PATENT DOCUMENTS

IT PI980066 * 8/1998 ..... 482/142
IT PI 980066 A1 3/2000

OTHER PUBLICATIONS

International Search Report for corresponding PCT application No. PCT/EP2018/076521, dated Jun. 25, 2019.

*Primary Examiner* — Andrew S Lo
*Assistant Examiner* — Andrew M Kobylarz
(74) *Attorney, Agent, or Firm* — Notaro, Michalos & Zaccaria P.C.

(57) ABSTRACT

A training apparatus having a frame with a pivot bearing on which a seat surface and/or a backrest are pivotably arranged, wherein the training apparatus has at least one actuator and a control unit with which the seat surface and/or the backrest are adjustable, wherein the at least one actuator is operatively connected to the frame and to the seat surface and/or to the backrest is disclosed.

11 Claims, 1 Drawing Sheet

(56) References Cited

U.S. PATENT DOCUMENTS

| | | | | |
|---|---|---|---|---|
| 10,806,963 | B2 * | 10/2020 | Staten | A63B 23/1218 |
| 10,940,359 | B2 * | 3/2021 | Lagree | A63B 24/0087 |
| 2004/0018923 | A1 * | 1/2004 | Schiff | A63B 21/4029 482/142 |
| 2009/0203505 | A1 * | 8/2009 | Kroll | A63B 21/078 482/104 |
| 2011/0082016 | A1 * | 4/2011 | Kim | A63B 21/078 482/94 |
| 2011/0172066 | A1 * | 7/2011 | Roppolo | A63B 21/078 482/104 |
| 2012/0088634 | A1 * | 4/2012 | Heidecke | A63B 22/0005 482/92 |
| 2012/0302413 | A1 * | 11/2012 | Katz | A63B 21/4035 482/142 |
| 2017/0001064 | A1 * | 1/2017 | Vorozilchak | A63B 21/4047 |
| 2017/0028246 | A1 * | 2/2017 | Vorozilchak | A63B 21/4029 |
| 2018/0326241 | A1 * | 11/2018 | Huskins | A63B 21/0058 |
| 2019/0329086 | A1 * | 10/2019 | Rindfleisch | A63B 21/0622 |
| 2020/0206562 | A1 * | 7/2020 | Green | B60K 17/165 |
| 2020/0338384 | A1 * | 10/2020 | Rindfleisch | A63B 21/078 |

* cited by examiner

TRAINING APPARATUS

FIELD OF THE INVENTION

The present invention relates to a training apparatus with weights, in particular a weight bench.

DESCRIPTION OF THE PRIOR ART

Weight benches are known from the prior art in which the seat surface and/or the backrest are manually adjustable, Depending on the type of exercise to be performed, the seat surface and/or the backrest must be adjusted differently. Exercises with or without dumbbells are aimed at training the arm, shoulder, chest, abdominal and back muscles. In order to position oneself correctly on a preset weight bench, the back is strained because, for example, with or without dumbbells in one's hands, one must lie on the essentially horizontally aligned backrest and also straighten up from this position. This can be cumbersome, uncomfortable or painful, for example for people with back problems, who should avoid straining theft backs as much as possible. Even for people without health problems, especially for those who train with heavy weights, lying down or straightening up can be a wrong form of load.

DESCRIPTION OF THE INVENTION

It is an object of the present invention to provide a training apparatus which can be climbed in a first position and in which a second position can be adjusted, wherein an undesired load on the user, in particular on his back, can be avoided during the adjustment of the second position.

This object is solved by a training apparatus having the features of claim 1. Further embodiments of the training apparatus are defined by the features of further claims.

A training apparatus according to the invention comprises a frame with a pivot bearing on which a seat surface and/or a backrest are pivotably arranged. The training apparatus comprises at least one actuator and a control unit with which the seat surface and/or the backrest can be adjusted, wherein the at least one actuator is operatively connected to the frame and to the seat surface and/or to the backrest. This allows a user to set up on the weight bench in a position that is comfortable for said user and can subsequently set an exercise position without straining the back. Thus, it is also possible for a person with back problems to strengthen the upper body by means of dumbbell training or by means of training with the body's own weight. Such a training apparatus also allows continuous adjustment of any position, which makes it very versatile for a wide range of exercises. The frame can be any structure to which a seat surface and/or a backrest can be pivotably attached. The seat surface and backrests may be pivotable about a common axis. Alternatively, they may have different pivot axes. The seat surface may be fixed to the frame and only the backrest may be adjustable. The frame may comprise three or four legs with or without feet, with which it can be securely placed on a base.

In one embodiment, the at least one actuator is an actuator selected from the group consisting of linear drives, which includes hydraulic cylinders pneumatic cylinders, ball-screw drives, roller-screw drives, worm drives, linear motors, and linear actuators.

In one embodiment, the at least one actuator is an actuator selected from the group consisting of rotary drives, which includes gear drives, toothed belt drives, V-belt drives, and chain drives.

In one embodiment, the training apparatus comprises a first actuator that is operatively connected to the seat surface and a second actuator that is operatively connected to the backrest. Thus, the seat surface is adjustable independently of the backrest. This allows a wide range of positions to be set. The positions can also be changed during an exercise, which provides additional comfort.

In one embodiment, the training apparatus comprises an input unit with which exercises can be selected for which specific exercise positions are stored.

In one embodiment, the training apparatus comprises at least one actuating device which is operatively connected to the control unit and with which the at least one actuator can be actuated.

In one embodiment, each actuator can be operated with one actuating device. Alternatively, all actuators can be actuated with a common actuating device.

In one embodiment, the control unit is configured such that activation of the actuating device can cause the seat surface and/or the backrest to pivot in a first direction, and wherein repeated activation of the actuating device can cause the seat surface and/or the backrest to pivot in a second direction opposite to the first direction.

In one embodiment, each actuator can be operated with two actuating devices each.

In one embodiment, the control unit is configured such that activation of the first actuating device can cause the seat surface or the backrest to pivot in a first direction, and wherein activation of the second actuating device can cause the seat surface or the backrest to pivot in a second direction opposite to the first direction.

In one embodiment, the control unit is configured to pivot the seat surface and/or backrest while the actuating device is activated and not pivot when the actuating device is not activated or when a predetermined position is reached.

In one embodiment, the control unit is configured such that the seat surface and/or the backrest is pivoted into a predetermined position when the actuating device is activated once.

In one embodiment, the at least one actuating device, is arranged on the frame and/or on the seat surface and/or on the backrest and/or on the floor next to the frame. Depending on the need, the actuating device may be arranged to be actuatable by the arms, i.e., the forearms, the elbows, or the upper arms, or to be actuatable, by the legs, i.e., the feet, the lower legs, the knees, or the thighs.

In one embodiment, the at least one actuating device is arranged on a footrest that is arranged on the frame.

In one embodiment, the first actuating device is disposed on a first side of the footrest and wherein the second actuating device is disposed on a second side of the footrest opposite the first side.

In one embodiment, the actuating device is selectable from the group comprising pushbutton, switch, swing lever, foot pedal, proximity sensor, and light barrier.

For example, both actuators can be operated with the at least one foot pedal. Such a design is suitable for training apparatuses in which sitting positions are predetermined and which can be selected by the user. For example, such a training apparatus can comprise an input unit which is operatively connected to the control unit and with which a specific exercise can be selected. The user selects an exercise before climbing onto the training apparatus and then takes a seat on the training apparatus together with the dumbbells. While seated, he can then press a pedal or pushbutton with one foot to set the exercise position. After the end of the exercise, repeated pressing of the pedal or pushbutton causes the entry position to be set again.

For example, the training apparatus comprises a first foot pedal with which the first actuator can be actuated and a second foot pedal with which the second actuator can be actuated.

For example, the at east one foot pedal is arranged on a footrest. Alternatively, a foot pedal can be arranged on the frame, for example on a leg or a foot of the frame. The foot pedal(s) can also be arranged movably with respect to the frame and can be connected to the control unit, for example, with a power or data cable.

Alternative solutions with wireless connections are also conceivable. For example, mats with integrated pedals or pushbuttons can be arranged in the floor area to the side of the seat.

For example, the first foot pedal is arranged on one side of the footrest and the second foot pedal is arranged on the opposite side of the footrest. Alternatively, a foot mat with pushbutton can be arranged to the left of the seat surface and one to the right.

For example, the training apparatus comprises at least one foot pedal operatively connected to the control unit, whereby the at least one actuator can be actuated by the at least one foot pedal. A foot pedal can be used to adjust the training apparatus without the need for hands. This is advantageous since the hands are needed to hold the dumbbells.

For example, actuating the at least one foot pedal in a first direction can cause the seat surface and/or the backrest to be tilted, and actuating the at least one foot pedal in a second direction opposite to the first direction can cause the seat surface and/or the backrest to be straightened. For example, the backrest may be lowered when the rear foot region, i.e., the heel, is pressed on the foot pedal and the backrest may be raised when the front foot region, i.e., the toes, are pressed on the foot pedal. For example, the seat surface can be tilted upward when the heel area is pressed on the foot pedal and the seat surface can be tilted downward when the toe area is pressed on the foot pedal. It is understood that the above-described actuation of the seat surface also works for the backrest and that of the backrest for the seat surface. Alternatively, the foot pedal can be designed in such a way that actuation can be performed by pivoting the foot sideways. As a further option, pushbuttons could be used on which the feet can be pressed.

In one embodiment, the at least one actuator is easily detachable from the seat surface and/or from the backrest, and the training apparatus comprises a manual locking device with which the seat surface and/or the backrest can be locked in predetermined positions. Thus, the training apparatus can be used even in the event of a power failure. Power for the training apparatus may include any type of external power supply. Alternatively, the training apparatus may comprise an integrated power supply with solar cells or a rechargeable power battery.

The mentioned embodiments of the training apparatus can be used in any combination, provided that they do not contradict each other.

BRIEF DESCRIPTION OF THE FIGURES

Exemplary embodiments of the present invention are explained in further detail below with reference to figures. These are for explanatory purposes only and are not to be construed restrictively. The figures show as follows.

DETAILED DESCRIPTION OF THE INVENTION

Figure 1:
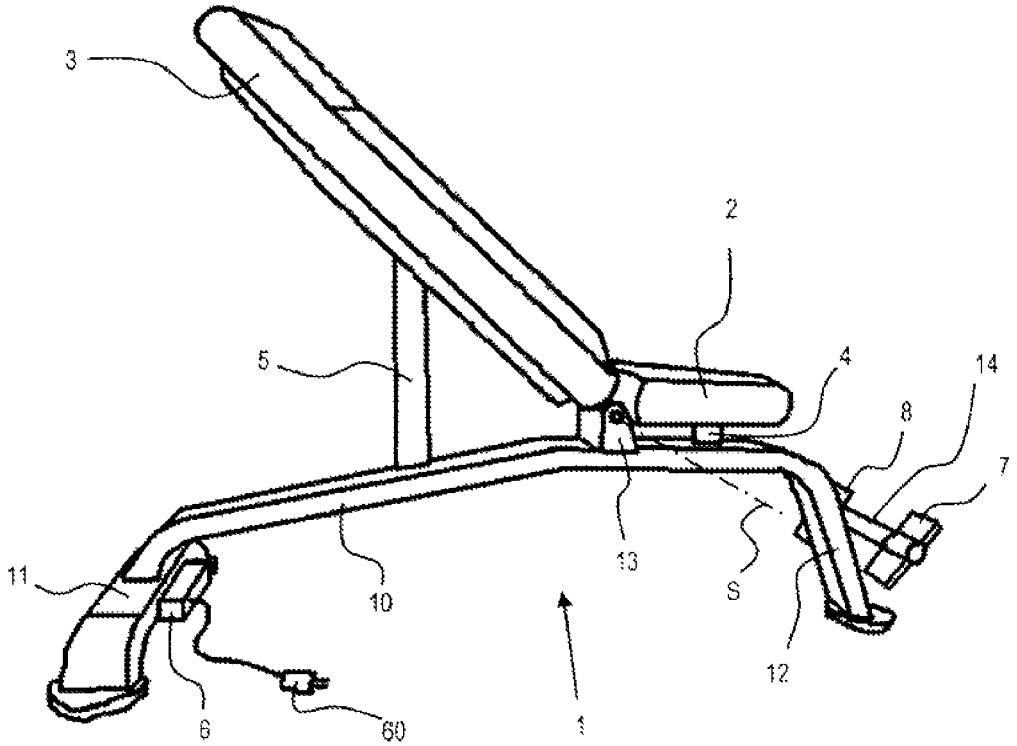
FIG. 1 shows a perspective view of a weight bench according to the invention in an entry position.
Figure 2:
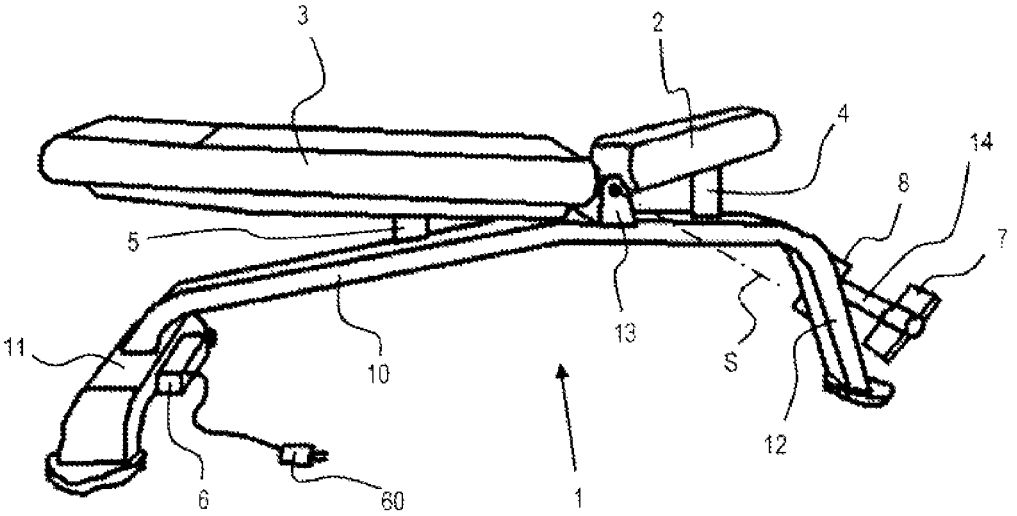
FIG. 2 shows the weight bench of FIG. 1 in an exercise position.

FIG. 1 shows a perspective view of a weight bench according to the invention in an entry position and FIG. 2 shows the weight bench of FIG. 1 in an exercise position.

The weight bench comprises a frame 1 having a support profile 10 on which a first foot part 11, a second foot part 12, a pivot bearing 13 and a footrest 14 are provided. The first foot part 11 comprises a cross member which is substantially perpendicular to the support profile 10 and projects laterally beyond the support profile 10. Feet are provided on the cross member in the region of the free ends.

The second foot part 12 comprises a leg which is formed together in one piece with the support profile 10 and at the free end of which a foot is provided. The footrest 14 is arranged on the leg of the first foot part 11 and extends substantially perpendicularly to the second foot part 12. A first foot pedal 7 is arranged at one lateral end of the footrest 14 and second foot pedal 8 is arranged at the opposite lateral end. Both foot pedals 7, 8 are pivotable with respect to the longitudinal center axis of the footrest 14. The pivot bearing 13 is arranged on the upper side of the support profile 10 and comprises a pivot axis S, which is substantially perpendicular to the support profile 10. The weight bench comprises a seat surface 2, which is pivotable about the pivot axis S of the pivot bearing 13. A first actuator 4 is arranged between the frame and the seat surface 2, which acts on the frame and on the seat surface 2. The weight bench further comprises a backrest 3, which can be pivoted about the pivot axis S.

A second actuator 5 is arranged between the frame and the backrest 3, which acts on the frame and on the backrest 3. The weight bench further comprises a control unit 6, which is operatively connected to the first actuator 4, the second actuator 5 and the two foot pedals 7, 8. The control unit is designed in such a way that, by actuating the first foot pedal 7, the seat surface 2 can be pivoted by means of the first actuator 4, and that, by actuating the second foot pedal 8, the backrest 3 can be pivoted by means of the second actuator 5. The control unit 6 comprises a power supply 60 with which the control unit 6 and the two actuators 4, 5 can be supplied with electrical power.

LIST OF REFERENCE MATERIALS

| | | | |
|---|---|---|---|
| 1 | Frame | 4 | First actuator |
| 10 | Support profile | 5 | Second actuator |
| 11 | First foot part | 6 | Control unit |
| 12 | Second foot part | 60 | Power supply |
| 13 | Pivot bearing | 7 | First foot pedal |
| 14 | Footrest | 8 | Second foot pedal |
| 2 | Seat surface | S | Pivot axis |
| 3 | Backrest | | |

The invention claimed is:

1. A training bench apparatus, comprising a frame having a pivot bearing on which a seat surface and/or a backrest are pivotably arranged, the training apparatus comprises at least one actuator and a control unit with which the seat surface and/or the backrest can be adjusted, wherein a first actuator is operatively connected to the frame and to the seat surface and wherein a second actuator is operatively connected to the frame and to the backrest, and a footrest arranged on the frame, and at least one actuating device, which is operatively connected to the control unit and with which the first actuator and/or the second actuator can be actuated, wherein the at least one actuating device is arranged on the seat surface and/or the backrest and/or at a lateral end of the footrest:

wherein the first actuator and the second actuator is an actuator selected from a group of linear drives which comprises hydraulic cylinders, pneumatic cylinders, ball-screw drives, roller-screw drives, worm drives, linear motors and linear actuators, or wherein the first actuator and the second actuator is an actuator selected from a group of rotary drives which comprises gear drives, toothed belt drives, V-belt drives and chain drives.

2. The training bench apparatus according to claim 1, comprising an input unit with which exercises can be selected, wherein specific exercise positions are stored for selectable exercises.

3. The training bench apparatus according to claim 1, wherein the first actuator is operable by a respective actuating device.

4. The training bench apparatus according to claim 3, wherein the control unit is designed such that activation of the at least one actuating device can cause the seat surface and/or the backrest to pivot in a first direction, and wherein repeated activation of the at least one actuating device can cause the seat surface and/or the backrest to pivot in a second direction opposite to the first direction.

5. The training bench apparatus according to claim 1, wherein the first actuator is operable with a first actuating device and a second actuating device.

6. The training bench apparatus according to claim 5, wherein the control unit is designed such that activation of the first actuating device can cause the seat surface or the backrest to pivot in a first direction, and wherein activation of the second actuating device can cause the seat surface or the backrest to pivot in a second direction opposite to the first direction.

7. The training bench apparatus according to claim 1, wherein the control unit is designed such that the seat surface and/or the backrest is pivoted while the actuating device is activated and is not pivoted when the actuating device is not activated or a predetermined position is reached.

8. The training bench apparatus according to claim 1, wherein the control unit is designed such that the seat surface and/or the backrest is pivoted into a predetermined position when the at least one actuating device is activated once.

9. The training bench apparatus according to claim 1, wherein the first actuating device is arranged on a first side of the footrest and wherein the second actuating device is arranged on a second side of the footrest opposite to the first side.

10. The training bench apparatus according to claim 1, wherein the at least one actuating device is selectable from a group comprising pushbuttons, switches, pivot levers, foot pedals, proximity sensors and light barriers.

11. The training bench apparatus according to claim 1, wherein the first actuator and the second actuator is easily detachable from the seat surface and/or from the backrest.

* * * * *